United States Patent [19]

Grunert et al.

[11] Patent Number: 4,713,639

[45] Date of Patent: Dec. 15, 1987

[54] CIRCUIT BREAKER WITH PUSH-TO-TRIP BUTTON AND TRIP BAR

[75] Inventors: Kurt A. Grunert, Beaver; Donald E. Schlosser, Beaver Falls, both of Pa.

[73] Assignee: Westinghouse Electric Corp., Pittsburgh, Pa.

[21] Appl. No.: 17,304

[22] Filed: Feb. 20, 1987

[51] Int. Cl.[4] ..... H01H 9/00

[52] U.S. Cl. ..... 335/172; 335/175; 335/59; 335/42

[58] Field of Search ..... 335/172, 173, 174, 175, 335/176, 63, 59, 64, 42, 8, 9, 10, 21, 164, 167, 45; 337/60, 70, 82, 81

[56] References Cited

U.S. PATENT DOCUMENTS

| | | | |
|---|---|---|---|
| 3,097,277 | 7/1963 | Wingard et al. | 335/45 |
| 3,808,567 | 4/1974 | Maier | 335/167 |
| 3,826,951 | 7/1974 | Maier et al. | 317/33 SC |
| 4,553,117 | 11/1985 | Schubring | 335/59 |
| 4,603,312 | 7/1986 | Conner | 335/42 |
| 4,603,313 | 7/1986 | Shimp et al. | 335/172 |

*Primary Examiner*—E. A. Goldberg
*Assistant Examiner*—Lincoln Donovan
*Attorney, Agent, or Firm*—L. P. Johns

[57] ABSTRACT

A push-to-trip button for a circuit breaker characterized by a circuit breaker within an insulating housing and having trip means for releasably holding a circuit breaker operating mechanism in an untripped position and including a trip bar biased in an untripped position, a trip delay member biased away from the trip bar and including an adjustment bar for applying a pressure on the member, a trip button extending through the housing and having a first surface contacting the trip bar, and the adjustment bar having a second surface for applying limited pressure on the trip button for holding the first surface in contact on the trip bar, without moving the trip bar to a tripped position.

5 Claims, 4 Drawing Figures

CIRCUIT BREAKER WITH PUSH-TO-TRIP BUTTON AND TRIP BAR

CROSS-REFERENCE TO RELATED APPLICATIONS

This application is related to copending application of A. B. Shimp and William B. Beatty, Ser. No. 771,376, filed Sept. 2, 1985, entitled "Circuit Breaker With Replaceable Rating Plug Interlock and Push-To-Trip Button"; of A. B. Shimp, Ser. No. 771,377, filed Aug. 30, 1985, entitled "Circuit Breaker with Interphase Flux Shunt Trip"; and of Kurt A. Grunert and James R. Farley, Ser. No. 845,302, filed Mar. 27, 1986, entitled "Circuit Breaker With Impact Trip Delay".

BACKGROUND OF THE INVENTION

1. Field of the Invention

This invention relates to circuit breakers of the type comprising a latched stored-energy mechanism releasable to effect tripping and, more particularly, it pertains to a push-to-trip button that is spacially located to orient with a trip bar latch.

2. Description of the Prior Art

A circuit breaker of the molded case type containing a latched stored-energy mechanism, releasable tripping of the circuit breaker, and trip means automatically operable in response to overload current conditions to affect release of the releasable mechanism is disclosed in U.S. Pat. No. 4,563,557.

SUMMARY OF THE INVENTION

In accordance with this invention, an improved multi-pole circuit breaker is provided which comprises a pair of separable contacts including a movable contact; a movable contact arm carrying the movable contact and movable between open and closed positions of the contacts; an operable mechanism for actuating the contact arm and comprising a pivotally supported releasable member; latching means for latching the releasable member and including a latch lever movable between latched and unlatched positions of the releasable member; trip means including a trip bar for releasably holding the latch lever in the latched position; the trip bar being movable between tripped and untripped positions; trip delay means for avoiding premature unlatching of the trip bar and including a body movable against the trip bar and biased away therefrom; a manually operated trip button having a first surface in contact with the trip bar; the trip delay means having an adjustment bar biased against the body for applying a prescribed pressure on the body; the adjustment bar having a second surface in contact with the trip button for holding the first surface in contact with the trip bar; the trip button being biased to the untripped position of the trip bar and including a U-shaped part including a bight portion and a pair of spaced legs which extend on opposite sides of the body of the time delay means and having aligned ends which together form said first surface contacting the trip bar; a spring engaging the bight portion for biasing the trip button to the untripped position of the trip bar; an insulating housing enclosing the trip delay and the trip bar which housing includes an opening through which the trip button extends; and the trip button having a shoulder portion engaging the inner wall of the housing surrounding the opening so as to shield the opening from the passing of vapor and particles incurred by arcing during opening of the contacts.

The advantage of this device is that it includes means for retaining and accurately locating the trip bar in place and permits repeatable tripping with possible variation of the latch engagement with the trip bar.

DESCRIPTION OF THE PREFERRED EMBODIMENT

Figure 1:
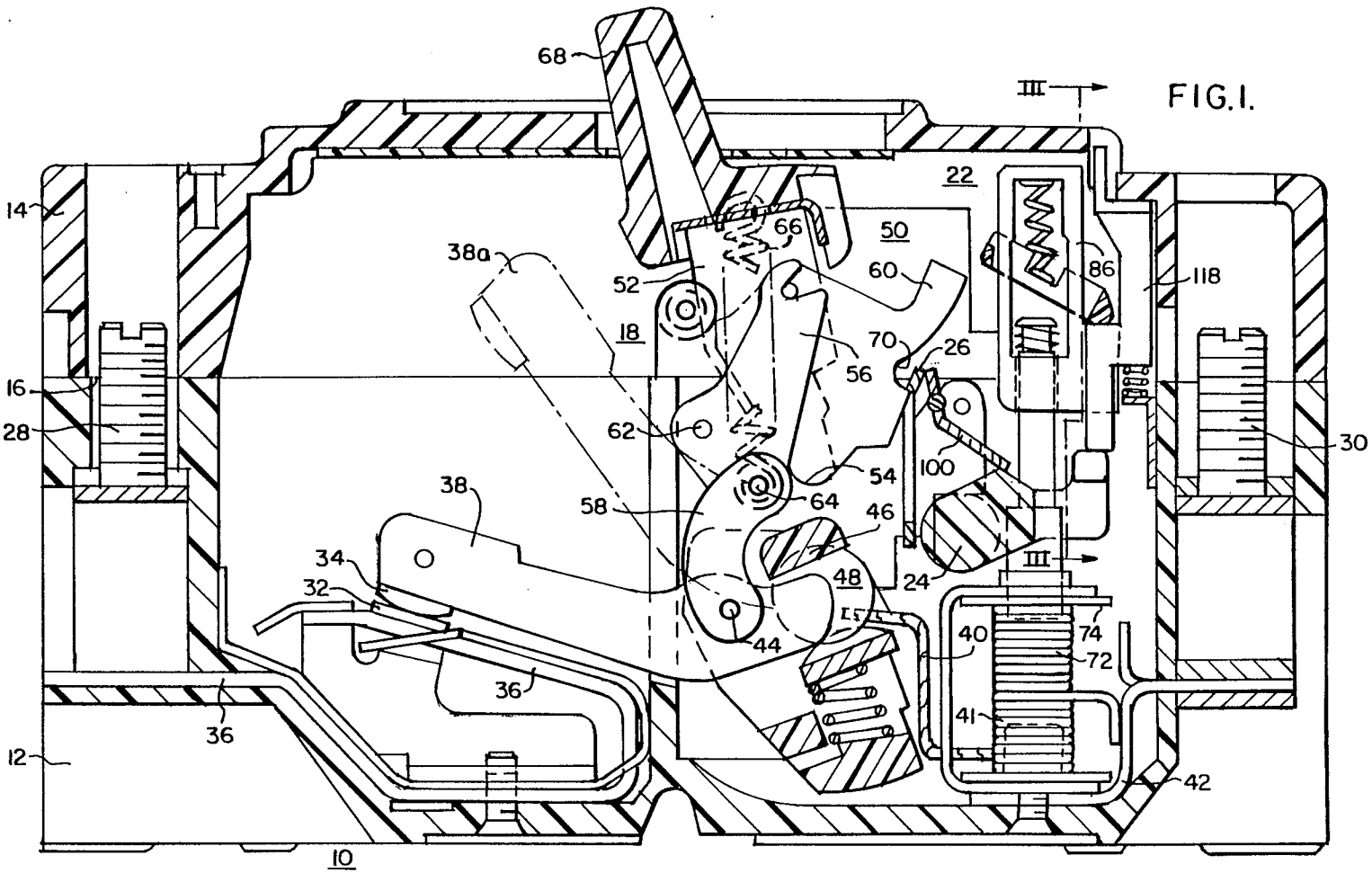
FIG. 1 is a vertical, sectional view through the center pole of a multi-pole circuit breaker showing the push-to-trip button of this invention.

In FIG. 1, a molded case circuit breaker is generally indicated at 10 and it comprises an insulating housing or base 12 having a cover 14 which is mechanically attached at a parting line 16 where the cover is retained in place by a plurality of fasteners (not shown). The circuit breaker may be of a single or multiple pole construction. The latter construction comprises insulating barriers separating the interior of the housing into adjacent side-by-side pole unit compartments in a well known manner. For the multiple pole unit, such as a three-pole circuit breaker, an operating mechanism 18 is disposed in a center pole unit. However, each pole includes a separate trip delay device 22 for rotating a trip bar 24 which in turn releases a latch lever 26.

For a polyphase circuit breaker, a pair of similar terminals including line terminal 28 and load terminal 30, at opposite ends of the housing 10, are provided for each phase. Terminals 28, 30 are employed to serially electrically connect the circuit breaker 10 into an electrical circuit, such as a three-phase circuit, to protect the electrical system involved.

The circuit breaker 10 is shown (FIG. 1) in the closed position with a pair of separable contacts including a fixed contact 32 and a movable contact 34 in electrical contact with each other. In that position, a circuit through a circuit breaker extends from the line terminal 28 through a conductor 36, contacts 32, 34, a contact arm 38, a shunt 40, a coil 41 in the trip delay device 22, and a conductor 42 to the load terminal 30.

The contact arm 38 is pivotally connected at a pivot pin 44 to a rotatable carriage 46, which is secured to or integral with a cross bar 48. The contact arm 38 and the carriage 46 rotate as a unit with the cross bar 48 during normal current conditions through the circuit breaker 10. The operating mechanism 18 is typical of that disclosed in U.S. Pat. No. 4,503,408 for which reason it is not described herein in detail. Suffice it to say, the mechanism 18 is positioned between spaced support plates 50 (one of which is shown) which are fixedly secured to base 12 of the center pole unit. An inverted U-shaped operating lever 52 is pivotally supported in U-shaped notches 54 on the plates with the ends of the legs of the lever supported in the notches of the plates.

Operating mechanism 18 includes an over-center toggle having an upper toggle link 56 and a lower toggle link 58 which connect the contact arm 38 to a releasable cradle member 60 that is pivotally supported on the plates 50 by a pin 62. The toggle links 56, 58 are pivotally connected by means of a knee pivot pin 64. Overcenter operating springs 66 are connected under tension between the knee pivot pin 64 and the bight portion of the lever 52. A handle 68 is mounted on the upper end of the lever 52 for manual operation of the operating mechanism 18.

Contacts 32, 34 are normally manually separated by movement of the handle 68 in the rightward direction from the position shown in FIG. 1 from the ON to the OFF position. However, inasmuch as the latch lever 26 of the trip delay device 22 engages a notch 70 of the cradle member 60, the circuit breaker 10 is in the untripped position as shown in FIG. 1. For the purpose of this invention, the circuit breaker operating mechanism 18 is shown as being tripped solely by the trip device 22. Other means for tripping, such as separate high-speed electromagnetic trip devices, are described elsewhere such as in U.S. Pat. No. 4,220,935.

Figure 2:
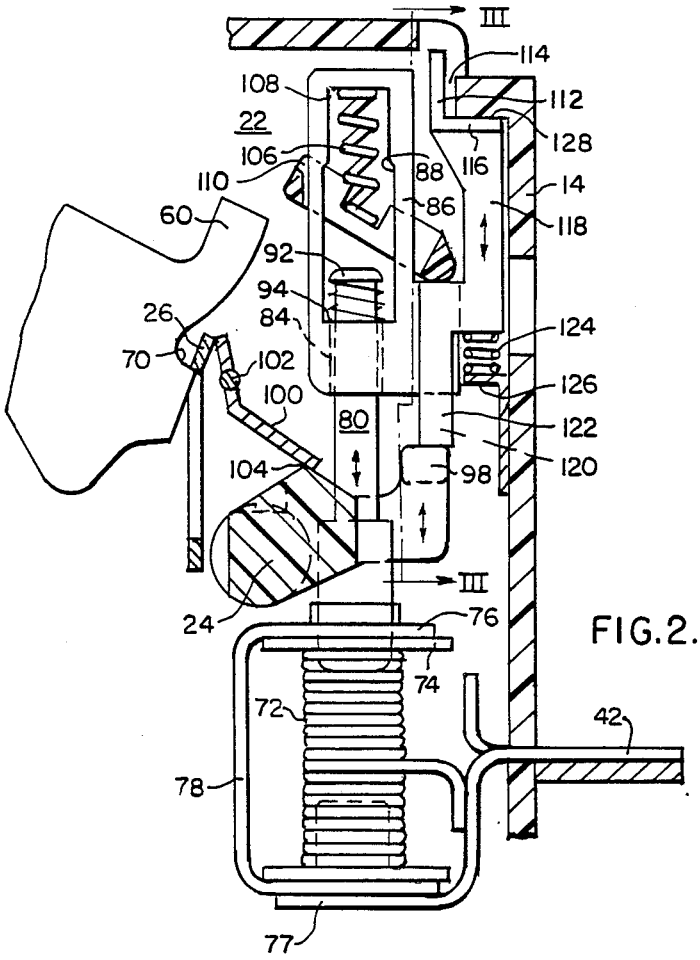
FIG. 2 is an enlarged, elevational view, partly in section, of the push-to-trip button in combination with the trip delay mechanism as used in the circuit breaker of FIG. 1.

When the operating mechanism 18 is tripped, by whatever means, such as the trip device 22, the contact arm 38 moves to the broken line position 38*a*. The magnetic device of this invention permits a delay of the trip function, at low level overcurrents, such that motor starting transient currents will not permanently trip the circuit breaker. The trip delay magnetic device 22 delays the mechanical motion after the application of an electrical impulse. For that purpose, the trip delay magnetic device 22 (FIG. 2) includes an electromagnetic solenoid including a coil 72 wrapped within a bobbin 74, which in turn is mounted within spaced frame members 76, 77 and a bight portion 78. A solenoid plunger 80 is movable vertically in and out of the coil 72 which extends through and is slidable in a hole 84 in a body 86.

The body 86 includes a window 88 in which a coil spring 90 is seated which spring is disposed around the upper end portion of the shaft 80 and between a button 92 and a lower surface 94 of the window 88. The button 92 is fixedly mounted on the upper end of the shaft 82. By this construction, the plunger 80 is held in the withdrawn position (FIG. 2) under normal current operating conditions.

Under normal operating conditions, current flows through the coil 72 and generates an electromagnetic force which attracts the plunger 80 downwardly into the coil by a distance proportional to the force and opposed by the coil spring 90 acting against the button 92. When slight overcurrents occur of a value less than that of a predetermined magnitude for tripping the circuit breaker, any resulting increases in the electromagnetic force applied by the coil upon the plunger 80 are resisted and absorbed by the coil spring 90 up to the force corresponding to the predetermined magnitude established for tripping. Thus, the spring 90 suppresses transient overcurrents to prevent nuisance tripping of the circuit breaker.

However, when an overcurrent of a predetermined magnitude occurs, an electromagnetic force of sufficient value pulls the plunger 80 downwardly against the spring 90 causing the button 92 to strike a lower surface 94, whereby the body 86 strikes an arm 98 of the trip bar 24. The trip bar is thereby rotated clockwise to enable a lever 100 pivoted at 102 to ride off a surface 104 of the arm, causing the lever 100 to rotate clockwise. As a result, the latch lever 26 is forced off of its latched position on the surface 70 of the cradle member 60, causing the cradle to rotate counterclockwise or upwardly and to trip the circuit breaker.

A coil spring 106 is disposed within the window 88 of the body 86 and extends between an upper surface 108 of the window and an adjustment bar 110 for adjusting for the desired pressure on the coil spring 90. The bar 110 is pivotally mounted and may be moved for adjustment in a suitable manner known in the art such as by a cam (not shown).

Figure 4:
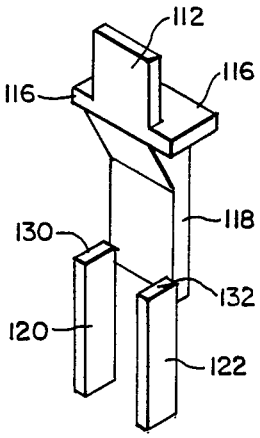
FIG. 4 is an isometric view of the push-to-trip button.

In accordance with this invention, a push-to-trip button 112 is mounted within the cover 14 and adjacent to the trip delay means 22. The upper end portion of the button 112 extends through an opening 114 in the cover 14. It includes a shoulder 116, a body 118, and a pair of legs 120, 122 (FIG. 4). The lower ends of the legs 120, 122 rest upon the arm 98 of the trip bar 24 so that downward pressure on the button 112 at the opening 114 causes the trip bar 24 to rotate clockwise and thereby trip the releasable cradle member 60. A coil spring 124 biases the body 118 upwardly upon release of the button 112. The lower end of the spring 124 is mounted on a frame portion 126 attached to the housing 12.

In the uppermost position of the push-to-trip button 112, the shoulder 116 is held against a surface 128 of the inner side of the cover 14 in order to prevent the gases generated during the occurrence of an arc during opening of the contacts 32, 34, from escaping through the opening 114. Moreover, the shoulder 116 against the surface 128 holds the legs 120, 122 in contact with the arm 98, thereby preventing counterclockwise rotation of the trip bar 24.

Figure 3:
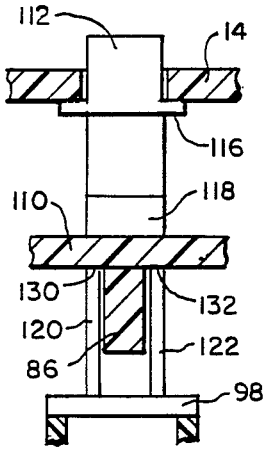
FIG. 3 is a vertical, sectional view, taken on the line III—III of FIG. 1.

As shown in FIG. 3, the legs 120, 122 are disposed on opposite sides of the body 86 of the trip delay device 22 so that the upper ends 130, 132 of the legs engage the adjustment bar 110 (FIG. 3). In this manner with upper and lower ends of the legs 120, 122 contained between the adjustment bar 110 and the arm 98 do not only hold the push-to-trip button accurately in place but to also maintain the spacing between the adjustment bar and the arm 98.

Accordingly, the push-to-trip button 112 is spacially located to orient with the desired magnetic air gap and the trip bar latching dimensions. No other positioning or stop means are required or necessary for locating the trip bar in place, thereby assuring repetitious operation of the trip bar.

Accordingly, the device of this invention provides for accurate tripping of the circuit breaker and includes accurate location of the trip bar in the space provided between the trip delay means and the circuit breaker housing.

What is claimed is:

1. A circuit breaker comprising:

a pair of separable contacts including a movable contact;

a movable contact arm carrying the movable contact and movable between open and closed positions of the contacts;

an operable mechanism for actuating the contact arm and comprising a pivotally supported releasable member;

latching means for latching the releasable member and including a latch lever movable between latched and unlatched positions of the releasable member;

trip means including a trip bar for releasably holding the latch lever in the latched position;

the trip bar being movable between tripped and untripped positions;

trip delay means for avoiding premature unlatching of the trip bar and including a body movable against the trip bar and biased away therefrom;

a manually operated trip button having a first surface in contact with the trip bar;

the trip delay means having an adjustment bar biased against the body for applying a prescribed pressure on the body; and the adjustment bar having a second surface in contact with the trip button for holding the first surface in contact with the trip bar.

2. The circuit breaker of claim 1 in which the trip button is biased to the untripped position of the trip bar.

3. The circuit breaker of claim 2 in which the trip button including a U-shaped portio including a bight portion and a pair of spaced legs, the legs extending on opposite sides of the body of the time delay means and having aligned ends which together form said first surface contacting the trip bar.

4. The circuit breaker of claim 3 in which a spring engages said bight portion for biasing the trip button to the untripped position of the trip bar.

5. The circuit breaker of claim 1 in which an insulating housing encloses the trip delay means and trip bar, the housing including an opening through which the trip button extends, and the trip button having a shoulder portion engaging the inner wall of the housing surrounding the opening so as to shield the opening from the passing of vapor and particles incurred by arcing during opening of the contacts.

* * * * *